US006832938B2

(12) United States Patent
Lenker

(10) Patent No.: US 6,832,938 B2
(45) Date of Patent: Dec. 21, 2004

(54) ELECTRICAL CONNECTOR WITH INTEGRAL WIRE RELEASE MEMBER

(75) Inventor: William Gary Lenker, Marysville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 100 days.

(21) Appl. No.: 10/318,419

(22) Filed: Dec. 13, 2002

(65) Prior Publication Data

US 2004/0116001 A1 Jun. 17, 2004

(51) Int. Cl.[7] ..... H01R 4/48
(52) U.S. Cl. ..... 439/835; 439/441
(58) Field of Search ..... 439/436, 437, 439/438, 439, 440, 441, 828, 834, 835

(56) References Cited

U.S. PATENT DOCUMENTS

| | | | | | |
|---|---|---|---|---|---|
| 4,759,726 | A | * | 7/1988 | Naylor et al. | 439/441 |
| 5,685,735 | A | * | 11/1997 | Hohorst | 439/441 |
| 5,915,991 | A | * | 6/1999 | Roman | 439/441 |
| 6,146,187 | A | * | 11/2000 | Pallai | 439/441 |
| 2002/0187670 | A1 | * | 12/2002 | Cisey | 439/441 |

* cited by examiner

*Primary Examiner*—Tho D. Ta

(57) ABSTRACT

An electrical connector assembly includes a housing having a chamber that retains a contact deflectable over a range of motion and a contact deflecting member. The chamber is configured to receive a wire and the contact is deflectable to make and break an electrical connection with the wire. The contact deflecting member is formed integrally with the housing and extends into the chamber. The contact deflecting member is positioned to engage and deflect the contact to make and break the electrical connection with the wire.

26 Claims, 8 Drawing Sheets

ELECTRICAL CONNECTOR WITH INTEGRAL WIRE RELEASE MEMBER

BACKGROUND OF THE INVENTION

The present invention generally relates to an electrical connector, and more particularly to an electrical connector that may be used to carry high-voltage power signals.

Electrical connectors are used to connect various forms of components and equipment. For example, some electrical connectors connect printed circuit boards to wires, which are used to convey power to appliances and utilities, such as lighting fixtures, ballasts and the like. Many appliances and utilities have high power demands. For example, many devices, such as lighting assemblies operate at very high voltage levels.

Conventional connectors include a housing that retains a plurality of electrical contacts. Each electrical contact has a terminal end that is configured to be mated with a printed circuit board. Within the connector, the contacts are also connected to wires from one or more appliances or utilities. Power signals are transferred between the wire and the printed circuit board through the electrical connector.

In many applications, it is desirable to have a wire release capable of repeatedly inserting and removing the wire from the connector. To afford the wire release, many connectors are configured to pinch or sandwich each individual wire between a corresponding contact and an interface wall of the connector housing. Certain connectors include contacts having a base portion secured in the housing and a contact tip that engages the wire. The base and contact tip of the contact are joined by a flexible portion that spring biases the contact tip toward the wire. The contact tip is deflected away from the electrical wire to remove the wire from the connector. However, if the contact tip is bent too far, the elasticity of the contact may be lost. When the contact elasticity is lost, the contact tip no longer returns to its original position and thus does not adequately pinch the wire against the wall of the connector once the wire is inserted. Thus, great care typically must be exercised when removing electrical wires from connectors to ensure that the contacts within the connector are not overly deflected in order to maintain the contact elasticity.

Recently, connectors have been proposed that include a contact deflection member that limits the range over which the contact is deflected when inserting and releasing a wire. The contact deflection member may simply constitute a push button that is slidably held in the connector housing. A lower end of the push button engages the contact tip, while an opposite end of the push button is configured to be pressed by the user. When the user presses the button, the lower end of the button bends the contact tip away from the wire. The connector housing may include stop features that permit the button to slide over a limited range of motion within the connector housing, thereby similarly limiting the amount of contact deflection.

However, the push button is a separate component that is individually inserted into a receptacle within the connector housing. Hence, separate and distinct molds and/or dies must be used to form the push button and the connector housing. Further, during assembly, each push button must be individually positioned within a corresponding receptacle in the connector housing. The separate molding and assembly steps unduly add cost and expense to the manufacturing process of the electrical connector.

Thus, a need exists for an electrical connector that maintains proper elasticity of electrical contacts housed within the electrical connector. A need also exists for a more cost-effective and efficient electrical connector that utilizes a contact deflection member.

BRIEF SUMMARY OF THE INVENTION

Embodiments of the present invention provide an electrical connector comprising a housing, contacts and contact deflecting members. The housing includes a plurality of chambers that retain an equal plurality of contacts. The chambers are configured to receive individual wires. The electrical contacts are deflectable to make and break electrical connections with the wires. The contact deflecting members are positioned proximate corresponding contacts and are configured to deflect the electrical contacts to break connections with corresponding wires. The contact deflecting members are disposed within channels formed in the housing and are integrally formed with the housing. Each contact deflecting member includes an end formed integrally with the housing through a hinge that pivotally joins the contact deflecting member to the housing. The electrical connector may also include an anti-overstress member provided in the chamber and positioned at an end of the range of motion of the contact to limit deflection of the contact. The range of motion may also be limited by an abutment of a contact end of the contact deflecting member and an interior wall of the housing. The electrical connector assembly may be a push button having an engagement surface extending from an exterior of the housing. The engagement surface is configured to receive a tool used to actuate the push button. The channel and the contact deflecting member are formed integrally with one another through a hinge that permits pivotal motion of the contact deflecting member laterally within the channel. The hinge is integrally formed with the contact deflecting member and the housing to enable pivotal motion of the contact deflecting member.

Figure 1:
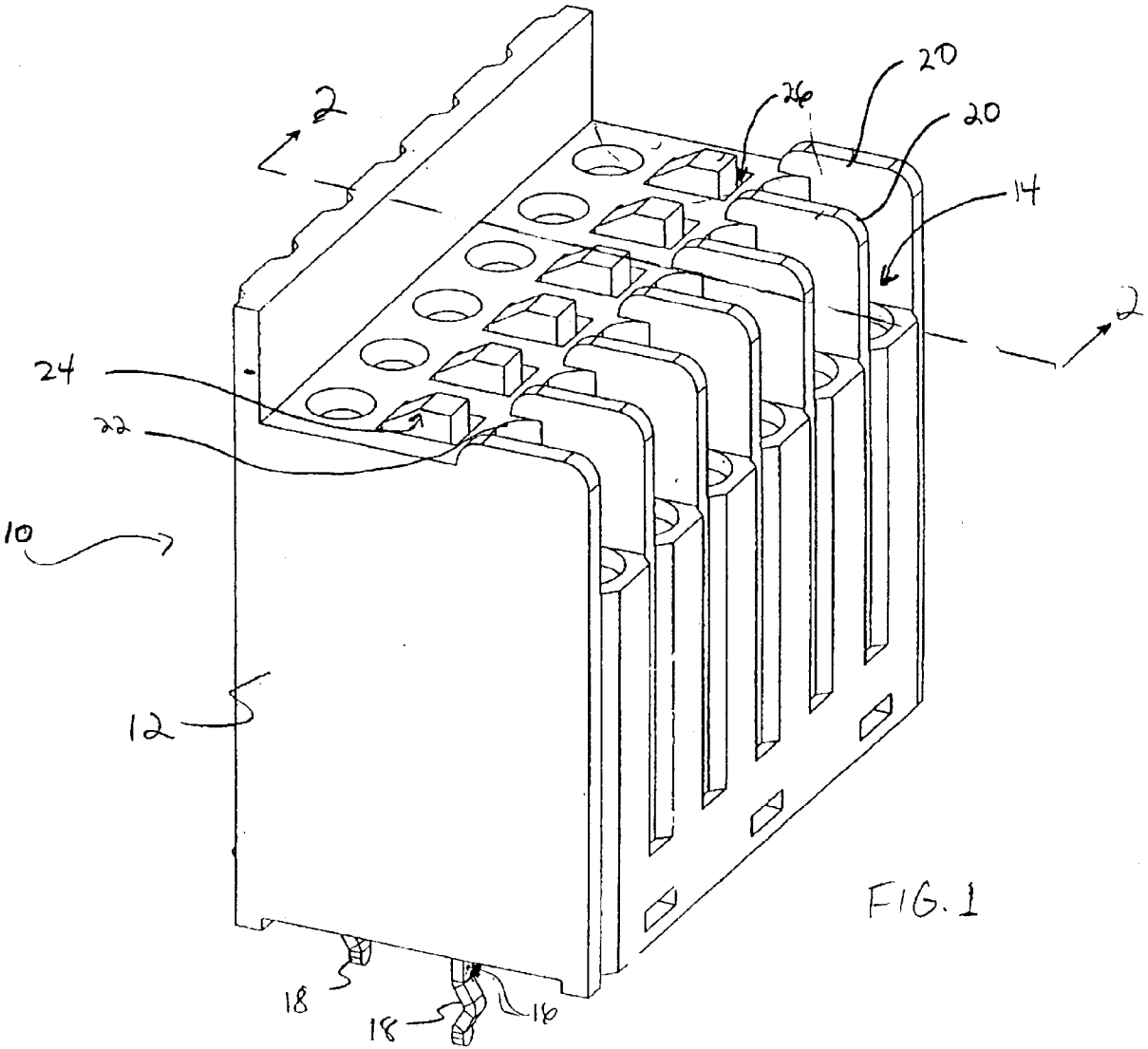
FIG. 1 illustrates an isometric view of a fully-assembled electrical connector according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates an isometric view of a fully-assembled electrical connector 10 according to an embodiment of the present invention. The electrical connector 10 includes a contact housing 12. The contact housing 12 includes an open end (not shown) exposing contact chambers (not shown) that receive and retain electrical contacts. A bottom cover may pivotally open and close over the open end through an integrally formed hinge. The electrical contacts may be loaded into the contact chambers through the open end.

The contact housing 12 has a plurality of wire troughs 14, which are configured to support wires in a desired orientation with respect to the contact housing 12, and contacts 16 (shown in greater detail, for example, with respect to FIG. 2) having circuit board engaging portions 18 extending downwardly from a bottom surface of the connector 10. Each wire trough 14 includes lateral support walls 20 and a rear support wall 22 that may conform to the contours of a wire.

The contacts 16 are further described with respect to U.S. application Ser. No. 10/197,161, entitled, "Anti-Overstress Electrical Connector," filed Jul. 17, 2002, and listing Navin Patel and William Lenker as inventors ("the '161 application). The '161 application is incorporated by reference herein in its entirety.

The electrical connector 10 also includes contact deflecting members, or push buttons 24, retained within channels 26. The push buttons 24 are integrally formed with the contact housing 12.

Figure 2:
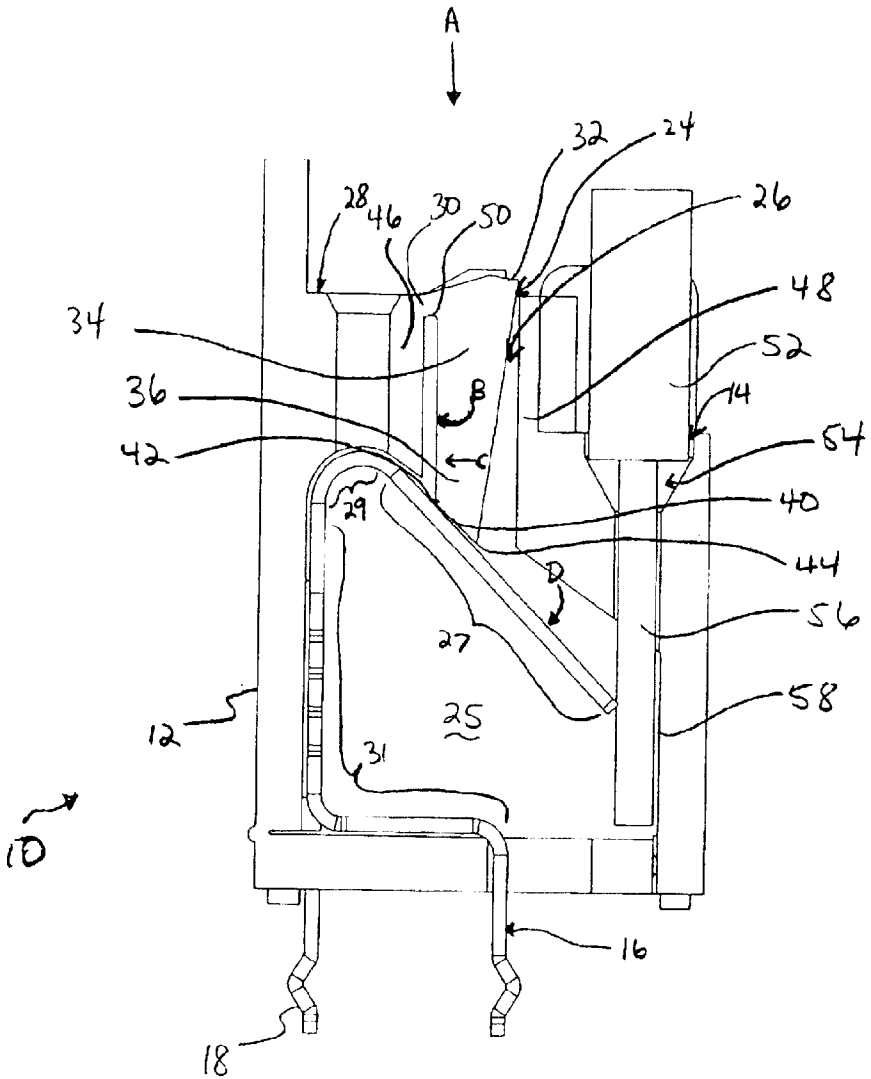
FIG. 2 illustrates a transverse cross-sectional view of an electrical connector taken along line 2—2 in FIG. 1.

FIG. 2 illustrates a transverse cross-sectional view of the electrical, connector 10 taken along line 2—2 in FIG. 1. A majority of each contact 16 is retained within an inner chamber 25 formed within the contact housing 12. The electrical contact 16 includes a contact tip 27 formed integrally with a curved flex portion 29, which is in turn joined with a base 31. The base 31 is, in turn, joined to the circuit board engaging portion 18, which extends downwardly from the contact housing 12. As shown in FIG. 2, the contact tip 27 is proximate the push button 24. The push button 24 may pivot into the inner chamber 25, thereby engaging and deflecting the contact tip 27 of the contact 16 (as discussed below).

Each push button 24 integrally connects with the contact housing 12 through a top surface 28 of the contact housing 12, or within the channel 26. The push button 24 is integrally formed with the contact housing 12, for example the top surface 28, as contiguous molded material. The push button 24 may integrally connect with the top surface 28 through an integral hinge 30.

The push button 24 may be used with or without anti-overstress features. The push button 24 includes an engagement surface 32 at an exterior end of a main body 34. The main body 34 is also formed with a contact end 36 that is distally located from the engagement surface 32. The contact end 36 is located proximate the contact tip 27 of the contact 16. The contact end 36 includes a lower surface 40 sloped to abut against the contact 16 when the push button 24 is pressed in the direction of line A. The lower surface 40 includes an upper contact corner 42 and a lower contact comer 44.

The push button 24 is formed within the channel 26 that is defined by first and second interior walls 46 and 48 of the contact housing 12. The push button 24 connects to the first interior wall 46 through the hinge 30 proximate the top surface 28. The hinge 30 extends downwardly from the top surface 28 along the first interior wall 46 toward a termination point 50. The termination point 50 may be anywhere along the first interior wall 46 provided that the hinge 30 allows the push button 24 to pivot sufficiently with respect to the first interior wall 46, while ensuring that the hinge 30 does not break away from the first interior wall 46 when the push button 24 is depressed.

In order to deflect the contact tip 27 of the electrical contact 16, the engagement surface 32 of the push button 24 is pressed in the direction of line A. Because the push button 24 is integrally formed with the contact housing 12 at hinge 30, the main body 34 of the push button 24 pivots toward the interior wall 46 along arc B. Consequently, the upper and lower contact comers 42 and 44 of the lower surface 40 move downward in the direction of line A, and toward the interior wall 46 in the direction of line C. The lower surface 40, or at least one of the contact comers 42 and 44, engages and deflects the contact tip 27 in the direction of arrow D. The range of deflection of the contact 16 may be limited by the range of motion of the push button 24. The movement of the push button 24 in the direction of arc B stops when the contact end 36 of the push button 24 abuts the first interior wall 46.

An electrical wire 52 is positioned within the wire trough 14. The wire trough 14 is in communication with the inner chamber 25 through a wire passage 54. The electrical wire 52 includes a stripped conducting portion 56 that is inserted into the electrical connector 10 until it contacts and extends past the contact tip 27. Once the electrical wire 52 is fully inserted into the electrical connector 10, the stripped conducting portion 56 is pinched between the contact tip 27 and an interior wall 58 of the electrical connector 10. Thus, an electrical path may be established between the electrical contact 16 and the electrical wire 52.

In order to release the electrical wire 52 from the electrical connector 10, the contact tip 27 of the electrical contact 16 is deflected. As mentioned above, when the electrical wire 52 is in a fully engaged position within the electrical connector 10, the electrical wire 52 is pinched between the electrical contact 16 and the interior wall 58 within the contact housing 12. To disengage the wire 52, the user presses downward on the engagement surface 32 in the direction of arrow A, thereby causing the push button 24 to pivot about hinge 30 along arc B. As the push button 24 pivots, it deflects the contact tip 27 of the contact 16 in the direction of arrow D. As the contact tip 27 deflects, it separates from the wire 52, thereby permitting the wire 52 to be easily removed from the wire passage 54.

Figure 3:
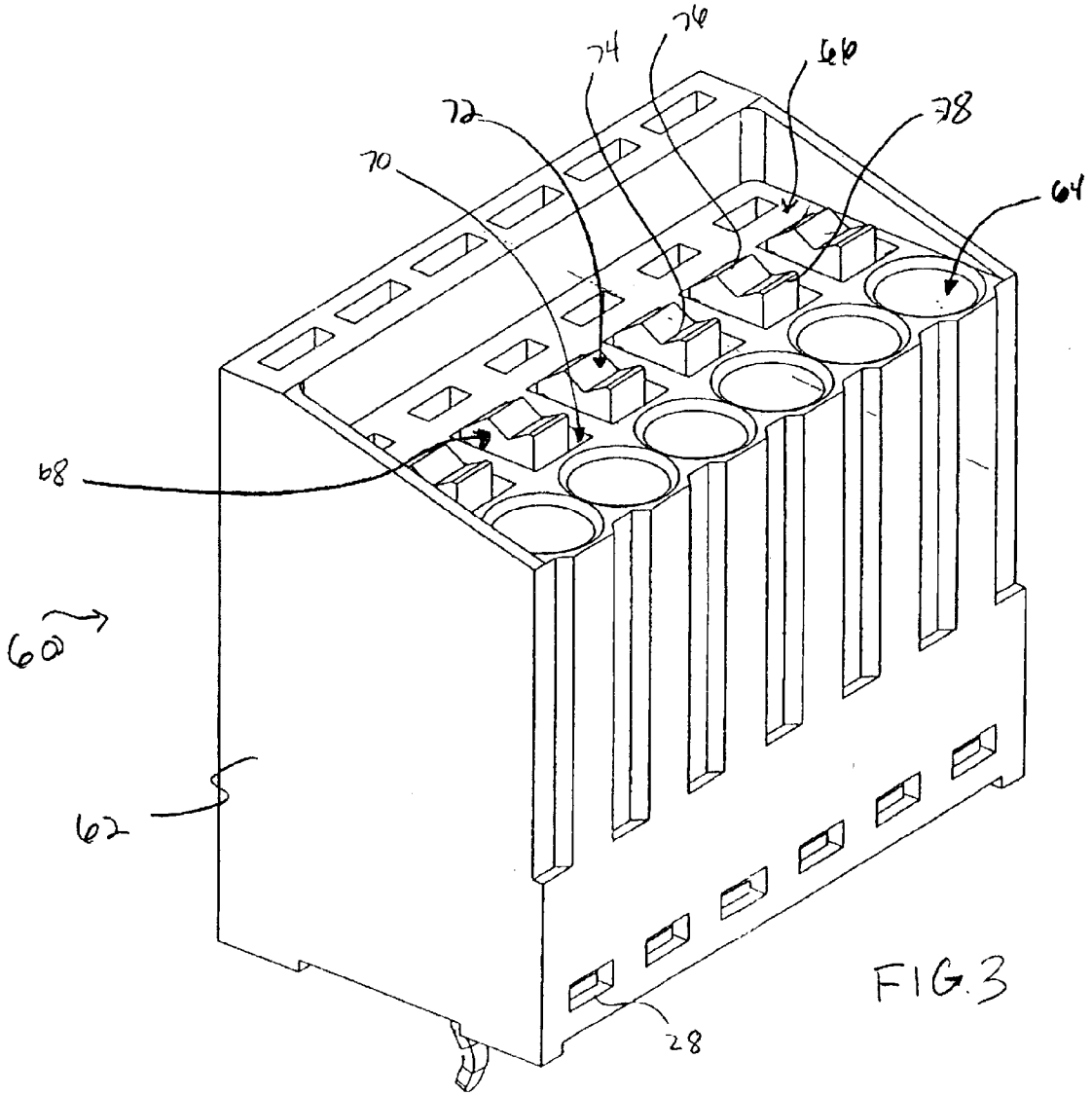
FIG. 3 illustrates an isometric view of a fully-assembled electrical connector according to an alternative embodiment of the present invention.

FIG. 3 illustrates an isometric view of a fully assembled electrical connector 60 according to an alternative embodiment of the present invention. The electrical connector 60 includes similar components to the embodiment described above. Like reference numerals are numbered the same as those described and shown with respect to FIGS. 1–2. The electrical connector 60 includes a contact housing 62 having wire channels 64, which are configured to support wires in a substantially vertical (or horizontal) orientation. Each wire channel 64 extends downwardly into the contact housing 62 from a top surface 66 of the contact housing 62.

The electrical connector 60 includes push buttons 68 retained within channels 70. The push buttons 68 include an engagement surface 72 that includes a divot 74 formed between two peaks 76 and 78. The engagement surface 72 is configured in this fashion so as to receive a tool, such as a screwdriver, which is used to actuate the push button 68. A screw head may be securely received within the divot 74.

Figure 4:
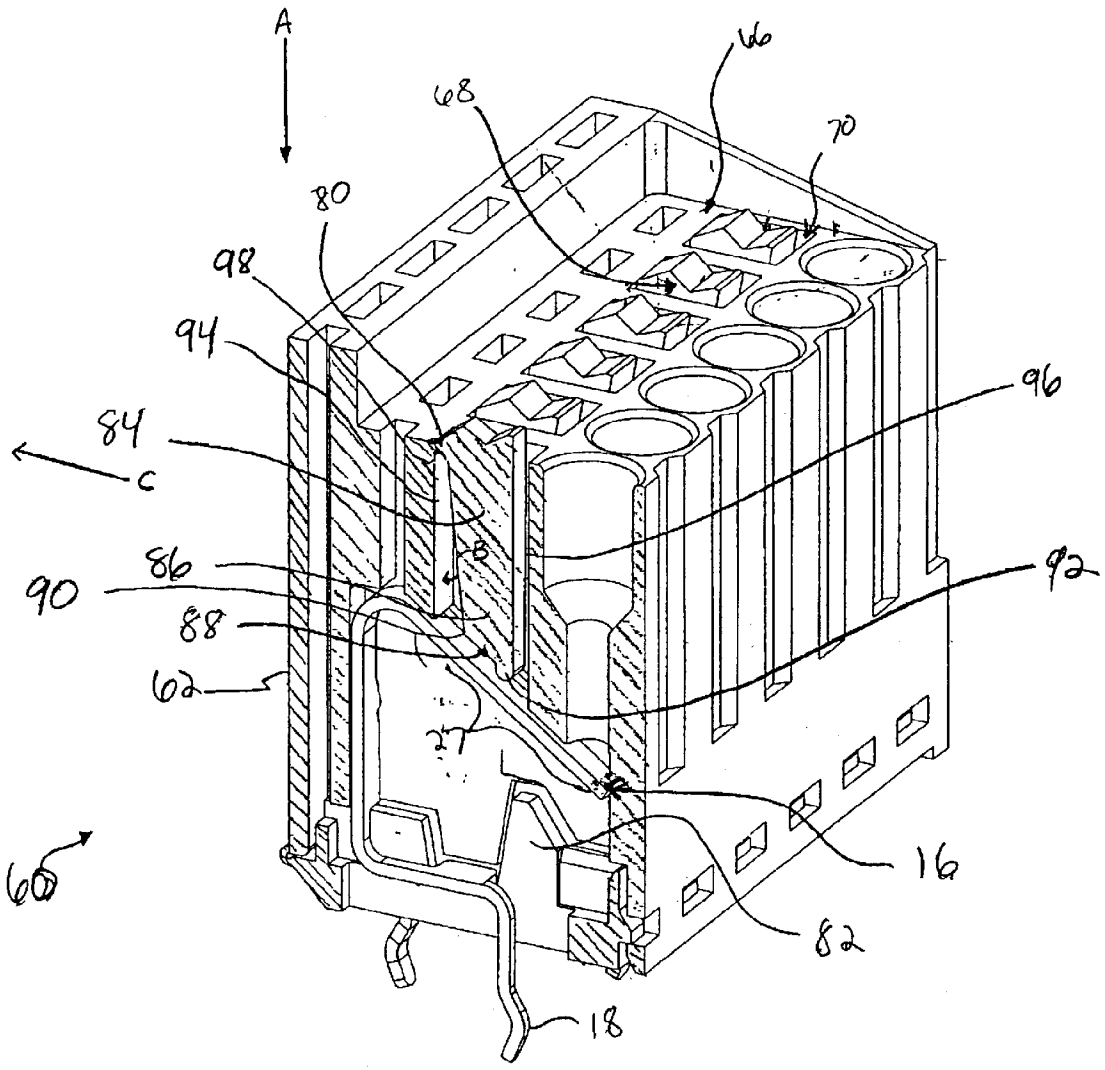
FIG. 4 illustrates an isometric partial interior view of an electrical connector showing a contact in an undeflected position according to an alternative embodiment of the present invention.

FIG. 4 illustrates an isometric partial interior view of the electrical connector 60 showing a contact 16 in an undeflected position. The push buttons 68 are integrally formed with the top surface 66 of the contact housing 62, or at a position within the channel 70, through a hinge 80. Each push button 68 is integrally formed with the contact housing 62. The push button 68 may be integrally formed within an electrical connector that may or may not include anti-overstress members 82.

Figure 6:
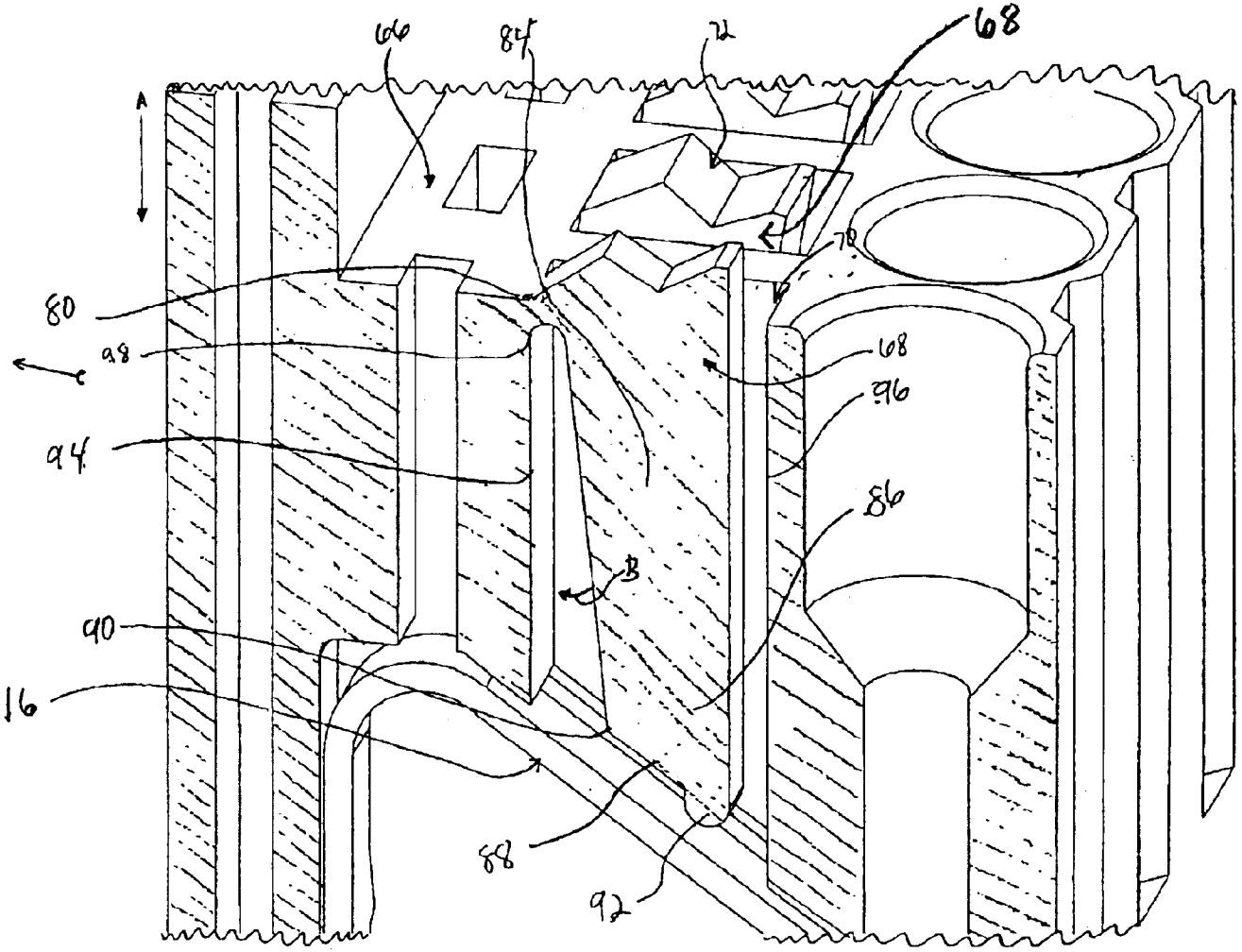
FIG. 6 illustrates an isometric partial interior view of an integrally formed push button according to an alternative embodiment of the present invention.

FIG. 6 illustrates an isometric partial interior view of the integrally formed push button 68. The engagement surface 72 is integrally formed with a main body 84 of the push button 68. The main body 84 is joined with a contact end 86 that is distally located from the engagement surface 72. The contact end 86 is located proximate the contact 16. The contact end 86 includes a lower surface 88 that abuts the contact 16 when the push button 68 is pressed in the direction of line A. The lower surface 88 includes an upper edge 90 and a lower rounded projection 92.

The push button 68 is formed within a channel 70 that is defined by first and second interior walls 94 and 96 of the contact housing 62. The push button 68 connects to the first interior wall 94 through the hinge 80 that is proximate the top surface 66. The hinge 80 extends downwardly from the top surface 66 along the first interior wall 94 toward a termination point 98. The termination point 98 may be anywhere along the first interior wall 94 provided that the hinge 80 allows the push button 68 to pivot with respect to the first interior wall 94, while ensuring that the hinge 80 does not break away from the first interior wall 94 when the push button 68 is depressed.

Figure 5:
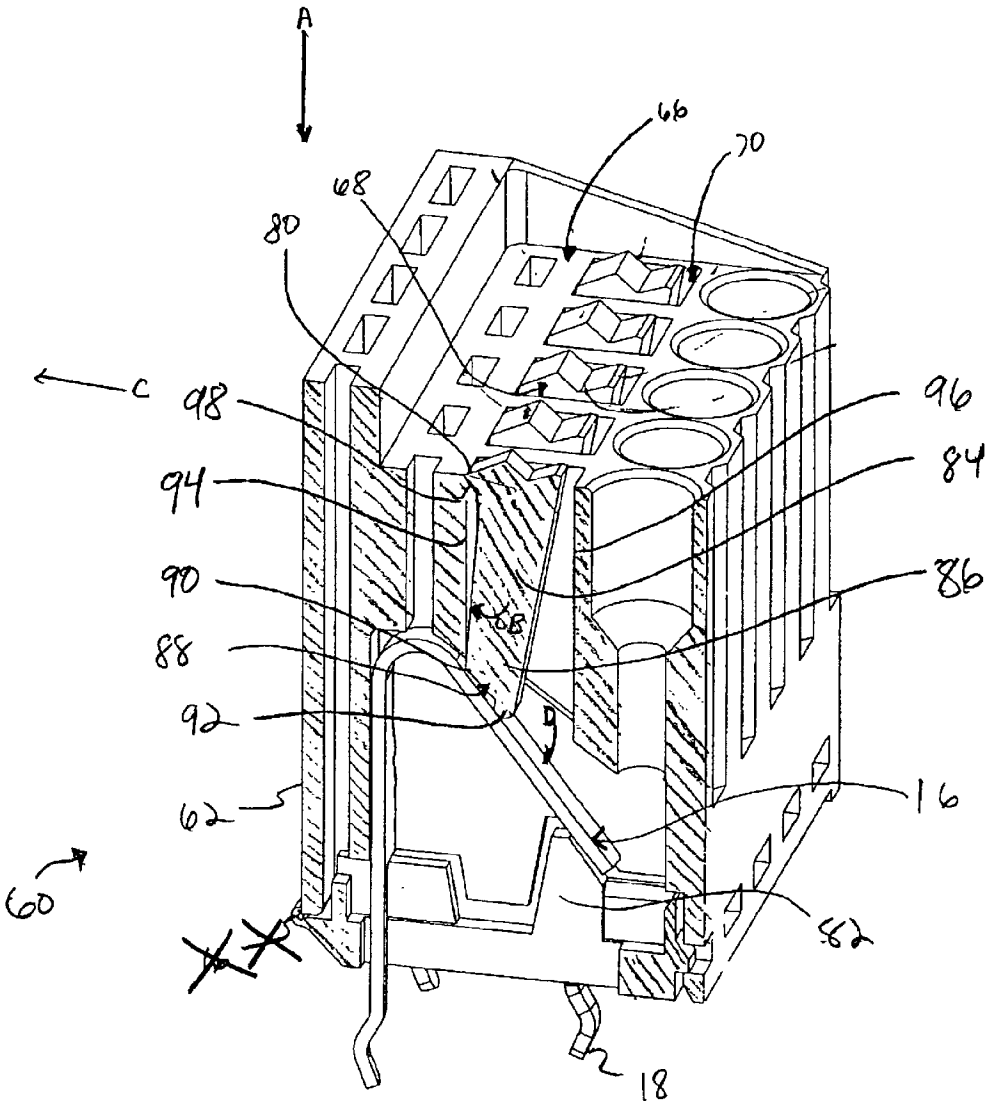
FIG. 5 illustrates an isometric partial interior view of an electrical connector showing a contact in a deflected position according to an alternative embodiment of the present invention.

FIG. 5 illustrates an isometric partial interior view of the electrical connector 60 showing a contact 16 in a deflected position. In order to deflect the electrical contact 16, the push button 68 is pressed in the direction of line A. Because the push button 68 is integrally formed with the contact housing 62 at the hinge 80, the main body 84 of the push button 68 pivots toward the interior wall 94 along arc B. Consequently, the upper edge 90 and the lower rounded projection 92 moved downwardly in the direction of line A, and toward the interior wall 94 in the direction of line C. Consequently, the lower rounded projection 92 and/or the upper edge 90 engages and deflects the contact 16 in the direction of arrow D. The upper edge 90 and the lower rounded projection 92 may both be rounded to minimize the possibility of damage to the contact 16 caused by scratching and/or snagging the contact 16. The range of deflection of the contact 16 is limited by the range of motion of the push button 68. The movement of the push button 68 in the direction of arc B stops when the contact end 86 of the push button 86 abuts the first interior wall 94.

The anti-overstress members 82 form a shelf or ledge, which also limits the movement of the electrical contact 16 in the direction of D. The anti-overstress members 82 are positioned so that the electrical contact 16 is not pushed past the point in which the electrical contact 16 loses, or substantially loses, its original elasticity.

Figure 7:
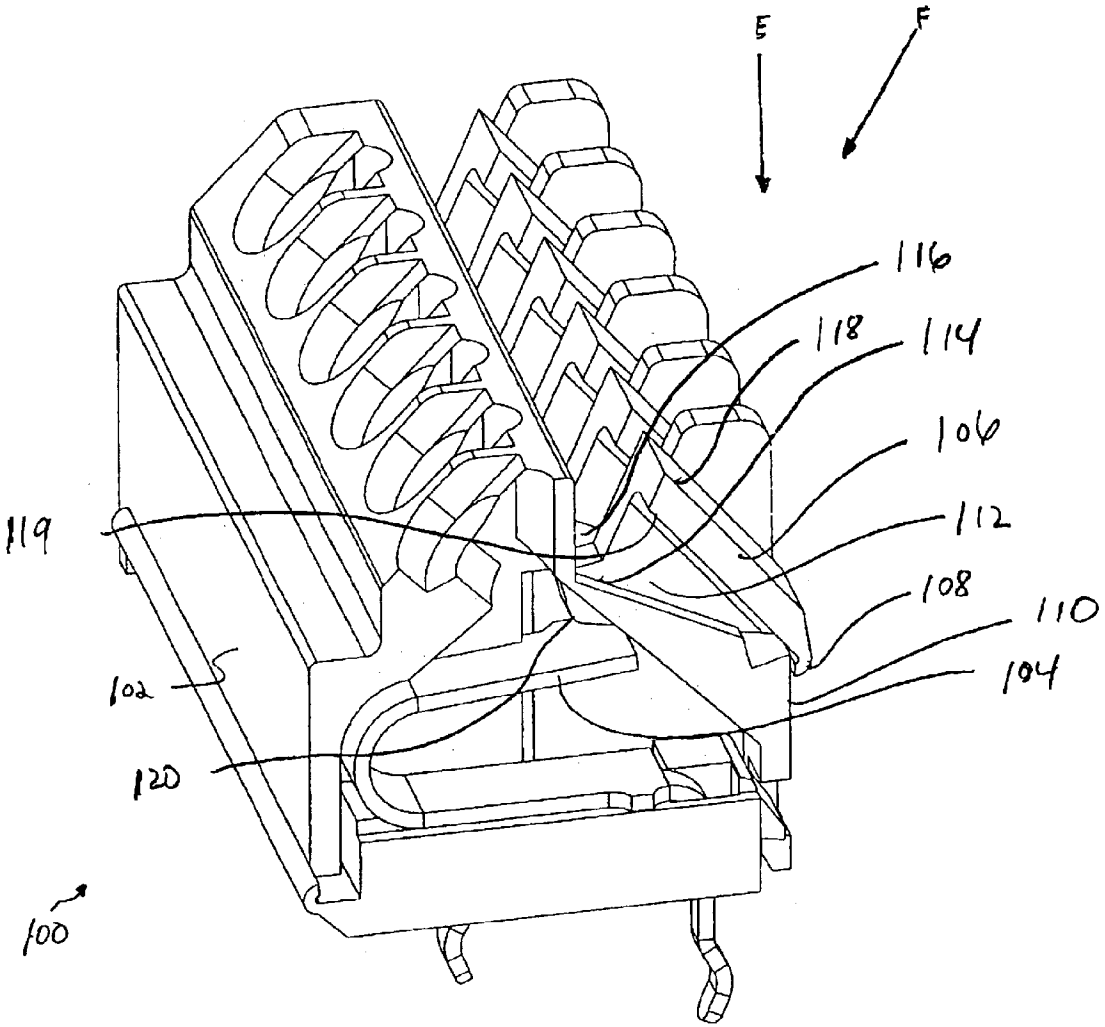
FIG. 7 illustrates an isometric partial interior view of an electrical connector showing a contact in an undeflected position according to a second alternative embodiment of the present invention.
Figure 8:
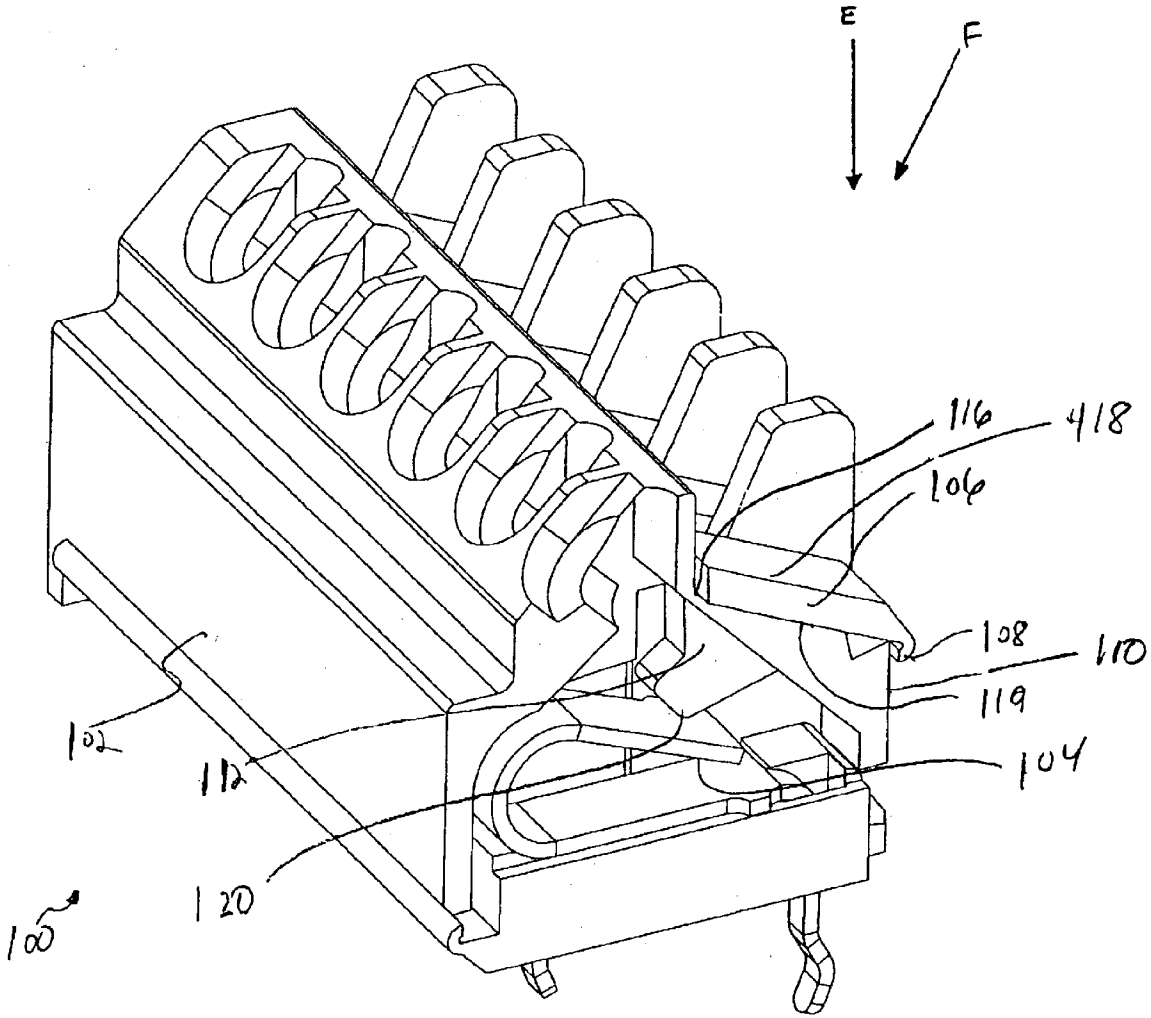
FIG. 8 illustrates an isometric partial interior view of an electrical connector showing a contact in a deflected position according to a second alternative embodiment of the present invention.

FIGS. 7 and 8 illustrates an isometric partial interior view of an electrical connector 100 showing a contact in non-deflected and deflected positions, respectively, according to a second alternative embodiment of the present invention. The connector 100 includes a main housing 102 that houses a plurality of contacts 104 and integrally formed push buttons 106. The push buttons 106 include a hinge 108 integrally formed with an outer lateral surface 110 of the housing 102. The housing 102 is formed so that a contact end 112 of the push button 106 is disposed within, and passes through, a slot 114 formed through the top surface 116 of the housing 102. The contact end 112 may slidably move through the slot 114.

The push button 106 also includes a ramped upper engagement surface 118 that is integrally formed with a lower motion limiting surface 119. The lower motion limiting surface 119 is formed with the contact end 112. The contact end 112 includes a protrusion 120, which may operatively abut the contact 104.

As the upper engagement surface 118 is pushed downwardly in the direction E, or in the direction F, the movement of the engagement surface 118 is translated through the push button 106 into the contact end 112. Similar to the embodiments described above, the push button 106 pivots relative to the housing 102 by way of the integrally formed hinge 108. Thus, the hinge 108 remains attached to the housing 102 and the contact end 112 moves through the slot 114. As the push button 106 moves toward the contact 104, the protrusion 120 engages and deflects the contact 104. The movement of the push button 106 is limited by the lower motion limiting surface 119 contacting the top surface 116 of the housing 102. That is, because the slot 114 is not wide enough to allow the lower motion limiting surface 119 to pass through, the motion of the push button 106 toward the contact 104 is halted by the lower motion limiting surface 119 contacting the top surface 116. Thus, the range of motion that the contact 104 may move during deflection is limited by the interaction of the lower motion-limiting surface 119 and the top surface 116 of the housing 102.

Embodiments of the present invention may be used with a wide variety of electrical equipment. For example, embodiments of the present invention may be used in high-voltage applications such as connecting components of fluorescent lighting ballasts. Embodiments of the present invention provide a more cost-effective and efficient electrical connector that utilizes integrally formed push buttons to deflect electrical contacts within the electrical connector. Because the push buttons are integrally formed, there is no need to separately mold and manufacture the push buttons. Also, because the push buttons are integrally formed, there are less component parts to assemble into the electrical connector during the manufacturing process, thereby saving time and labor.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly, comprising:

a housing having a chamber that retains a contact deflectable over a range of motion, said chamber being configured to receive a wire, said contact being deflectable to make and break an electrical connection with the wire;

a contact deflecting member extending into said chamber, said contact deflecting member being positioned to engage and deflect said contact to make and break the electrical connection with the wire; and a hinge integrally formed with said contact deflecting member and said housing, said hinge pivoting to permit lateral deflection of said contact deflecting member in said chamber.

2. The electrical connector of claim 1 further comprising an anti-overstress member provided in said chamber and positioned at an end of said range of motion of said contact to limit deflection of said contact.

3. The electrical connector assembly of claim 1, wherein said contact deflecting member is a push button having an engagement surface extending from an exterior of said housing, said engagement surface being configured to receive a tool used to deflect said push button.

4. The electrical connector assembly of claim 1, wherein said housing includes a channel that receives said contact deflecting member, said hinge permitting pivotal motion of said contact deflecting member laterally within said channel.

5. The electrical connector assembly of claim 1 wherein said hinge does not break away from said contact deflecting member and said housing throughout pivotal motion of said contact deflecting member.

6. The electrical connector assembly of claim 1, wherein said range of motion is limited by an abutment of a contact end of said contact deflecting member and an interior wall of said housing.

7. The electrical connector assembly of claim 1, wherein said contact includes a deflection portion having a tip configured to sandwich a wire against a side wall of said chamber, said contact deflecting member engaging said deflection portion of said contact.

8. The electrical connector assembly of claim 1, wherein said contact deflecting member pivots laterally within a channel formed in said housing, said contact deflecting member having a side wall that abuts against a side wall of said channel to limit pivotal motion of said contact deflecting member.

9. The electrical connector of claim 1, wherein said hinge is formed integral with said contact deflecting member and said housing proximate a top surface of said housing.

10. The electrical connector assembly of claim 1, wherein said hinge remains integrally joined to said contact deflecting member and said housing throughout operation of said contact deflecting member while depressed and after being released.

11. An electrical connector assembly comprising:

a housing having a plurality of chambers, each of said chambers retaining a contact deflectable over a range of motion and communicating with corresponding passages configured to receive wires, said contacts being deflectable to make and break connections with corresponding wires; and contact deflecting members disposed within individual channels in said housing, said contact deflecting members formed integrally with said channels through hinges that pivotally attach said contact deflecting members to said housing, said contact deflecting members deflecting said contacts to make and break connections with corresponding wires.

12. The electrical connector of claim 11 further comprising anti-overstress members provided in said chambers and positioned at an end of said range of motion of said contacts to limit deflection of said contacts.

13. The electrical connector assembly of claim 11, wherein each of said contact deflecting members is a push button having an engagement surface extending from an exterior of said housing, said engagement surface being configured to receive a tool used to deflect said push button.

14. The electrical connector assembly of claim 11, wherein said range of motion of each contact is limited by an abutment of a contact end of a corresponding one of said contact deflecting members and an interior wall of a corresponding one of said individual channels.

15. The electrical connector assembly of claim 11, wherein each of said contacts includes a deflection portion having a tip configured to sandwich a wire against a side wall of said chamber, said contact deflecting members engaging said deflection portions of said contacts.

16. The electrical connector assembly of claim 11, wherein said contact deflecting members pivot laterally within said individual channels formed in said housing, said contact deflecting members having side walls that abut against side walls of said individual channels to limit pivotal motion of said contact deflecting members.

17. The electrical connector of claim 11, wherein said hinges are formed integral with said contact deflecting members and said housing proximate a top surface of said housing.

18. The electrical connector assembly of claim 11, wherein said hinges remain integrally joined to said contact deflecting members and said housing throughout operation of said contact deflecting member while depressed and after being released.

19. An electrical connector assembly, comprising:

a housing having a chamber defined by interior walls that retains a contact deflectable over a range of motion, said chamber being configured to receive a wire, said contact being deflectable to make and break a connection with the wire; and a push button deflecting said contact to make and break the connection with the wire, said push button being disposed within a channel and comprising an end informed integrally with said housing through a hinge, said push button having an engagement surface that is configured to receive a tool used to deflect said push button.

20. The electrical connector of claim 19 further comprising an anti-overstress member provided in said chamber and positioned at an end of said range of motion of said contact to limit deflection of said contact.

21. The electrical connector assembly of claim 19, wherein said hinge permits pivotal motion of said push button laterally within said channel.

22. The electrical connector assembly of claim 19, wherein said range of motion is limited by an abutment of a contact end of said push button and an interior wall of said channel.

23. The electrical connector assembly of claim 19, wherein said contact includes a deflection portion having a tip configured to sandwich a wire against a side wall of said chamber, said push button engaging said deflection portion of said contact.

24. The electrical connector assembly of claim 19, wherein said push button pivots laterally within said channel, said push button having a side wall that abuts against a side wall of said channel to limit pivotal motion of said push button.

25. The electrical connector of claim 19, wherein said hinge is formed integral with said push button and said housing proximate a top surface of said housing.

26. The electrical connector assembly of claim 19, wherein said hinge remains integrally joined to said push button and said housing throughout operation of said push button while depressed and after being released.

* * * * *